US005979121A

United States Patent [19]

Bennington

[11] Patent Number: 5,979,121

[45] Date of Patent: Nov. 9, 1999

[54] WIND RESISTANT DWELLING

[76] Inventor: Thomas Bennington, 334 D Lake Farm Rd., Smyrna, Tenn. 37167

[21] Appl. No.: 09/106,078

[22] Filed: Jun. 29, 1998

[51] Int. Cl.[6] ..... E04B 1/346; B64F 1/12

[52] U.S. Cl. ..... 52/65; 52/64; 52/114; 52/111; 244/115

[58] Field of Search ..... 52/64, 65, 114, 52/111, DIG. 14; 244/115

[56] References Cited

U.S. PATENT DOCUMENTS

| | | | |
|---|---|---|---|
| 592,190 | 10/1897 | Bond . | |
| 1,153,292 | 9/1915 | Downey | 52/65 X |
| 1,353,798 | 9/1920 | Stevens . | |
| 2,209,858 | 7/1940 | Steiert . | |
| 2,792,794 | 5/1957 | Miller . | |
| 3,408,777 | 11/1968 | Ghirelli . | |
| 3,567,161 | 3/1971 | Adams . | |
| 3,645,052 | 2/1972 | Hanna . | |
| 3,670,464 | 6/1972 | Cutter | 52/65 X |
| 3,905,166 | 9/1975 | Kaiser . | |
| 3,958,381 | 5/1976 | Meyer . | |
| 4,019,292 | 4/1977 | Pedro . | |
| 4,360,175 | 11/1982 | Mellblom et al. . | |
| 4,817,345 | 4/1989 | McGlew . | |
| 5,671,568 | 9/1997 | Armanno, Sr. . | |

FOREIGN PATENT DOCUMENTS

| | | |
|---|---|---|
| 592577 | 2/1960 | Canada . |
| 1186367 | 4/1970 | United Kingdom . |

*Primary Examiner*—Christopher T. Kent
*Assistant Examiner*—Brian E. Glessner
*Attorney, Agent, or Firm*—Richard C. Litman

[57] ABSTRACT

A wind resistant habitable dwelling which includes the fuselage of an aircraft rotatably mounted on a support column. The tail fin of the fuselage is retained to allow the dwelling to pivot about the support column and point into the direction of the prevailing wind. The fuselage of the aircraft has points along its undercarriage support framework for attachment of a rotatable support column, which is cylindrical in shape. The support column includes a bearing assembly and a gearing system. The bearing assembly defines a single axis of rotation that is perpendicular to a level ground surface, so that the fuselage is capable of pivoting about the support column within a plane parallel to the level ground surface. The gearing system, which is also attached to the fuselage of the aircraft, is driven by motors and is capable of being further controlled by both dampening and braking assemblies housed in the support column. Access to the support column is provided by a ground level hatchway.

3 Claims, 2 Drawing Sheets

WIND RESISTANT DWELLING

BACKGROUND OF THE INVENTION

1. Field of the Invention

The invention relates in general to building structures and, more particularly, to certain new and useful improvements in wind resistant dwellings.

2. Description of the Related Art

Severe weather events are common occurrences in the United States and other countries. The damaging winds produced by these events are responsible for the destruction of real and personal property and loss of life. Houses and commercial buildings are typically the most conspicuous casualties seen in the aftermath of such storms.

Because high winds have such a devastating affect on habitable structures, there is a need for dwellings resistant to excessive wind loading. The present invention offers a improved method of fabricating a habitable dwelling capable of withstanding severe wind forces. The present invention satisfies this need by mounting, on a rotatable support column, the fuselage of a commercial jetliner that has been withdrawn from service. The design and configuration of the fuselage enables it to always point into the wind thereby presenting the smallest cross-sectional area to the destructive wind forces.

Emergency Shelters

There are many emergency-type shelter structures known in the patent art which are designed to withstand catastrophic events. For example, U.S. Pat. No. 592,190, issued to Bond on Oct. 19, 1897 shows a cyclone shelter essentially comprised of a roofed cage capable of descending into an excavated pit. In addition, U.S. Pat. No. 2,792,794, issued to Miller on May 26, 1955 describes a bomb shelter equipped with a moveable roof-forming closure made of materials capable of resisting intense heat and radiation. Further, U.S. Pat. No. 5,671,568, issued to Armanno, Sr., on Sep. 30, 1997, discloses a hurricane shelter with a domed-shaped cover, elevationally supported by a column, and a cylindrical base wall.

The above shelter structures are not designed for long-term or continuous use as a habitable dwelling. As such, their utility is limited to the problem solved namely, short-term protection of individuals during a catastrophic event. On the other hand, the present invention is specifically designed as a habitable dwelling in addition to being resistant to the forces produced by high wind.

Rotating Building Structures

The concept of rotatably mounting a habitable dwelling on a support column is known in the patent literature. However, the prior art does not suggest rotatably mounting a wind resistant dwelling as embodied by the present invention. For instance, U.S. Pat. No. 3,905,166, issued to Kaiser on Sep. 16, 1975, shows a rotatable building structure supported upon a stationary base. Additional examples of similar structures are U.S. Pat. No. 3,408,777, issued to Ghirelli on Nov. 26, 1965 and U.S. Pat. No. 4,817,345, issued to McGlew on Apr. 4, 1989.

Although the above structures are rotatably mounted, thee rotation is not related to decreasing the effect of wind loading. The Ghirelli structure rotates to follow the sun. The McGlew and Kaiser structures, on the other hand, rotate to provide a continuously changing view of the surrounding scenery. While the present invention is provided with a mechanical rotating means to position the structure in a desired position, it is primarily designed to freely pivot about its support column to point into the direction of the wind during a severe weather event.

Aircraft Weather Vane Moorings

Weathervaning tie down devices for light aircraft are known in the patent literature. These devices permit free turning or "weathervaning" of the aircraft in response to prevailing winds to minimize the possibility of wind damage associated with severe weather conditions. For example, U.S. Pat. No. 3,567,161, issued to Adams on Mar. 2, 1971, discloses a weathervaning tie down device for tricycle gear light aircraft comprising a support framework and a mechanism for elevating and lowering the support framework. When the Adams device is elevated, the light aircraft, positioned on the support framework, is free to rotate into the prevailing wind. A similar device is shown in U.S. Pat. No. 4,360,175, issued to Mellblom et al. On Nov. 23, 1982.

These weathervaning devices are used with actual light aircraft, not just the fuselage of such aircraft. Accordingly, these devices require the aircraft to have working landing gear capable of being received along their support frameworks. In addition, the structural limitations of the support frameworks and rotating means make weathervaning devices appropriate only for light aircraft. They are, therefore, not used with large commercial jetliners.

None of the above inventions and patents, taken either singularly or in combination, is seen to describe the instant invention as claimed. Thus a wind resistant dwelling solving the aforementioned problems is desired.

SUMMARY OF THE INVENTION

The present invention, generally stated, provides a new fabrication for a building structure which provides increased protection against wind damage attributable to severe weather events such as thunder storms, tornados and hurricanes.

Briefly described, the preferred embodiment of this invention comprises the fuselage of an aircraft (such as a commercial jetliner withdrawn from service) which has been converted into a habitable dwelling, rotatably mounted on a support column. The fuselage of such an aircraft has been engineered and tested to withstand wind speeds in excess of five hundred (500) mph, temperatures below negative fifty (−50) degrees Fahrenheit and stress forces greater than 2.5 gravities.

Market forces have made certain types of commercial aircraft structures similar in cost per square foot to that of conventional ground based dwellings. Such aircraft include Boeing 727's that have been removed from active service. Of course, the quality of the materials used in the fabrication of, and the engineering associated with, such aircraft are far superior than those seen in most wood-framed homes.

The fuselage of such an aircraft has a plurality of points along its undercarriage support framework for attachment to the upper portion of a rotatable support column. The support column is substantially cylindrical in shape having a lower portion which is secured to a mounting base. The mounting base is rigidly fixed to the ground.

The upper portion of the support column, in addition to being attached to the fuselage, also includes a bearing assembly which defines a single axis of rotation that is perpendicular to a level ground surface. Accordingly, the fuselage is capable of pivoting about the support column within a plane parallel to the level ground surface.

The upper portion further includes a gearing means attached to the fuselage of the aircraft. The gearing means is driven by motors and capable of being further controlled by both dampening and braking assemblies housed in the support column. Access to the support column is provided by a ground level hatchway.

In converting the fuselage into a habitable dwelling, many of the aircraft's original components are removed, However, the tail fin structure of the fuselage is retained. Retention of the tail fin structure allows the fuselage to pivot about the support column and point into the direction of the prevailing wind. The fuselage can also be rotated in a manual mode by the motor driven gearing means.

Accordingly, it is a principal object of the invention to provide a habitable dwelling that is resistant to damage from high wind forces.

It is another object of the invention to provide a habitable dwelling that is rotatably mounted on a support column fixed to the ground.

It is a further object of the invention to provide a habitable dwelling fabricated from aircraft-quality materials.

Still another object of the invention is to provide a habitable dwelling design based on aerospace engineering principles.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
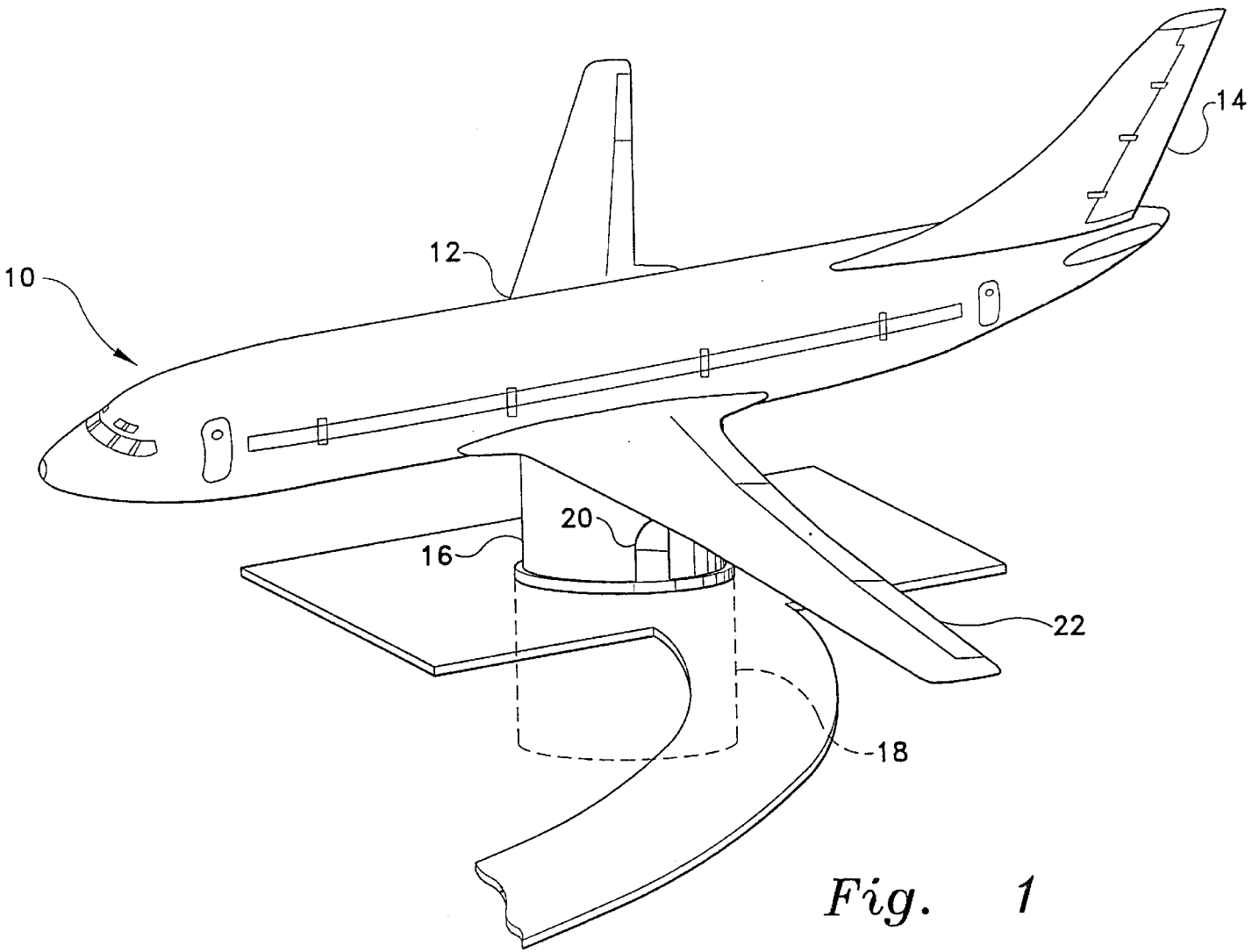
FIG. 1 is a perspective view of one form of wind resistant dwelling according to the present invention.

With reference first to FIG. 1, the wind resistant dwelling of the subject invention is shown generally at 10 and is shown for reference and descriptive purposes with a jetliner fuselage 12 installed. Although many types of commercial aircraft fuselages are suitable for use as a wind resistant dwelling, a generic form of jetliner fuselage 12 is shown as a representative example of the manner and best mode for fabricating the wind resistant dwelling 10 as described herein.

Figure 2:
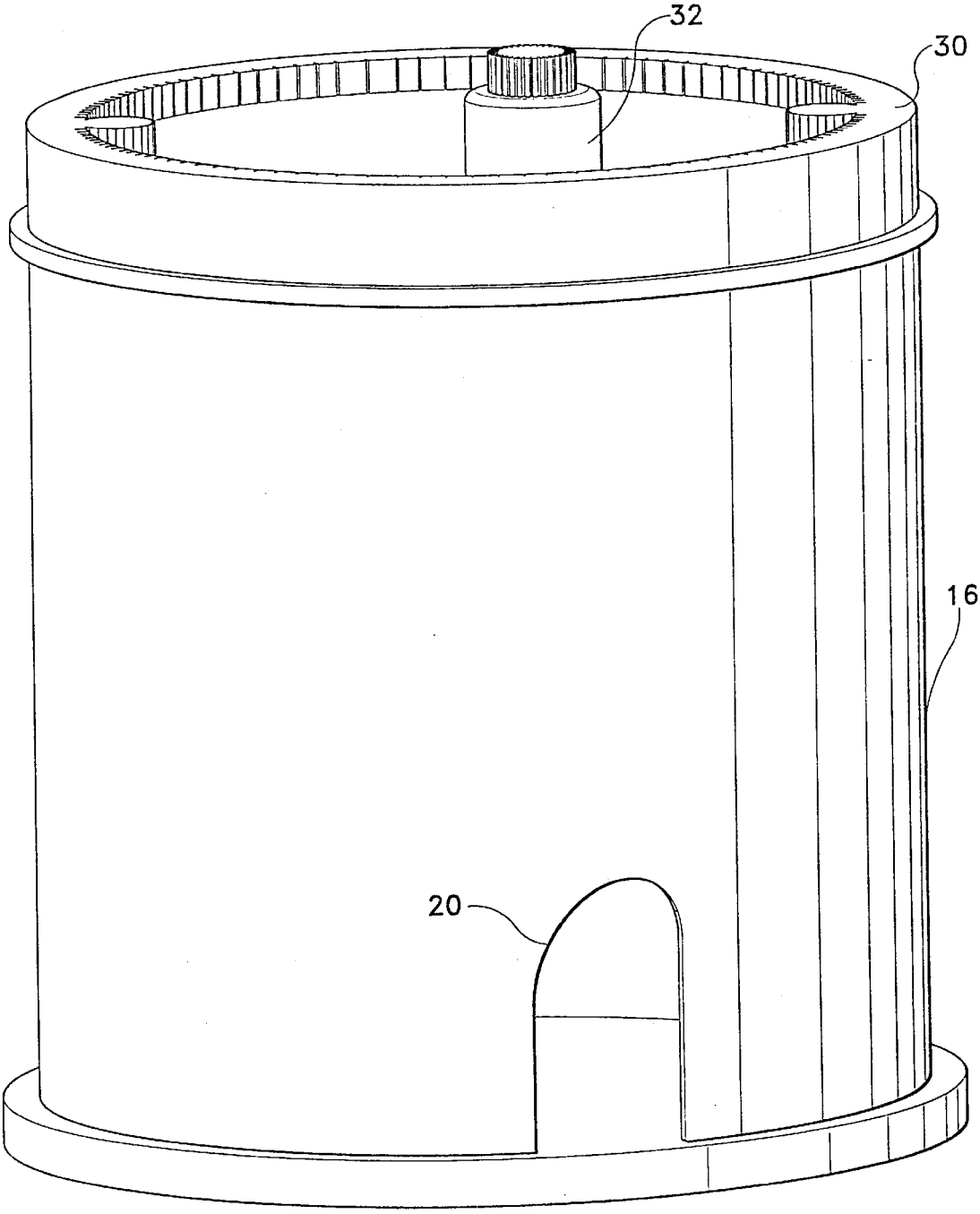
FIG. 2 is a perspective view of the support column of the wind resistant dwelling of FIG. 1.

With reference now to both FIGS. 1 and 2, the individual items will be described in greater detail. The wind resistant dwelling comprises a jetliner fuselage 12 rotatably mounted on a support column 16. The wings 22 can be maintained on the fuselage 12 as part of the dwelling 10 or removed at the option of the user. If the wings 22 remain, they are configured in such a manner so that they are unable to create lift. However, the horizontal stabilizers (not shown) are removed from the fuselage 12. In addition, the cabin and holds within the fuselage 12 have been refurbished to provide the internal fixtures of a habitable dwelling.

The fuselage 12 has a plurality of points (not shown) along its undercarriage support framework for attachment to the upper portion of the support column 16. On a typical fuselage 12, these points may include the keel beam (not shown) and the landing gear rear trunnion support beam (not shown).

The upper portion of the support column 16 contains a bearing assembly 30 with an axis of rotation parallel to the longitudinal axis of the support column 16. The bearing assembly 30 is connected to the fuselage 12 by load bearing members (not shown). One end of each load bearing member is attached to the upper surface of the bearing assembly 30. The other end of each load bearing member is attached to the undercarriage support framework of the fuselage 12.

The bearing assembly 30 also includes a gearing means. The upper portion of the support column 16 contains a motor driven control means 32 coupled to the gearing means of the bearing assembly 30. The motor driven control means 32 rotates the fuselage when the user wishes the dwelling 10 to face a direction other than the direction the fuselage 12 would normally point if free to rotate with the prevailing wind. The motor driven control means 32 also contains dampening and braking assemblies to further assist in controlling the rotation and stability of the dwelling 10.

Access to the internal structures of the support column 16 is provided by a ground level hatchway 20. The mounting base 18 of the support column 16 is rigidly fixed to the ground or other load bearing surface, such as the bed of a body of water, in a manner which provides adequate support and stability to the dwelling 10.

A principal aspect of the present invention is the retention of fuselage's 12 tail fin assembly 14. The tail fin assembly 14, combined with the rotatable support column 16, allows the fuselage 12 to point into the prevailing wind direction.

It is to be understood that the present invention is not limited to the embodiment described above, but encompasses any and all embodiments within the scope of the following claims.

I claim:

1. A habitable dwelling comprising:

an airplane fuselage including:

a body, having upper, lower, forward and rearward portions, said body comprising a structural framework covered with a metallic skin;

a horizontal axis defined between said forward and rearward portions;

a vertical axis defined between said upper and lower portions;

a tail fin assembly mounted at said rearward and upper portions of said body, said tail fin assembly extending vertically from said body and parallel to said horizontal axis of said body;

a foundation assembly being adapted to be connected to a surface of the earth for rotatably supporting said airplane fuselage, said foundation assembly comprising:

a support structure having an internal portion, an upper portion and a mounting base portion, wherein said mounting base portion is fixed within the surface of the earth;

a longitudinal axis defined between said upper portion of said foundation and said mounting base portion;

a cylindrical bearing assembly mounted at said upper portion of said foundation, said cylindrical bearing assembly having a single axis of rotation parallel to said longitudinal axis of said foundation assembly;

a means for attaching said cylindrical bearing assembly to said airplane fuselage;

a means for controlling the rotation of said cylindrical bearing assembly; and a means for accessing said internal portion of said support structure.

2. The habitable dwelling according to claim 1, wherein said means for accessing said internal portion of said support structure comprises a hatchway.

3. The habitable dwelling according to claim 1, wherein said cylindrical bearing assembly further comprises an annular gear fixed along the internal circumference of said cylindrical bearing assembly.

* * * * *